US009506176B2

(12) United States Patent
Laguatan et al.

(10) Patent No.: US 9,506,176 B2
(45) Date of Patent: Nov. 29, 2016

(54) THREAD COLORING APPARATUS

(71) Applicant: CRAYOLA, LLC, Easton, PA (US)

(72) Inventors: Roseld V. Laguatan, Bath, PA (US); James Allen, Nazareth, PA (US); Oliver Morris, Evenwood Close (GB)

(73) Assignee: Crayola, LLC, Easton, PA (US)

( * ) Notice: Subject to any disclaimer, the term of this patent is extended or adjusted under 35 U.S.C. 154(b) by 0 days.

(21) Appl. No.: 14/701,174

(22) Filed: Apr. 30, 2015

(65) Prior Publication Data

US 2016/0010254 A1 Jan. 14, 2016

Related U.S. Application Data

(63) Continuation-in-part of application No. 14/490,314, filed on Sep. 18, 2014.

(51) Int. Cl.

| | |
|---|---|
| ***B05B 13/02*** | (2006.01) |
| ***B05C 1/06*** | (2006.01) |
| ***B05C 13/00*** | (2006.01) |
| ***D06B 1/10*** | (2006.01) |
| ***D06B 11/00*** | (2006.01) |
| ***A63H 33/30*** | (2006.01) |
| ***B65H 54/28*** | (2006.01) |
| ***B65H 57/00*** | (2006.01) |
| ***B65H 71/00*** | (2006.01) |
| *B05C 3/12* | (2006.01) |

(52) U.S. Cl.

CPC ..... *D06B 1/10* (2013.01); *A63H 33/3088* (2013.01); *B65H 54/28* (2013.01); *B65H 57/006* (2013.01); *B65H 71/00* (2013.01); *D06B 11/0026* (2013.01); *B05B 13/0207* (2013.01); *B05C 1/06* (2013.01); *B05C 3/125* (2013.01); *B05C 13/00* (2013.01); *B65H 2701/31* (2013.01)

(58) Field of Classification Search

None

See application file for complete search history.

(56) References Cited

U.S. PATENT DOCUMENTS 2,366,198 A * 1/1945 Kresse ..... D06B 1/10 118/223
3,098,373 A * 7/1963 Langston ..... D06B 11/0026 118/234

(Continued)

FOREIGN PATENT DOCUMENTS

| | | | |
|---|---|---|---|
| DE | 4427687 | A1 | 2/1996 |
| JP | H11106133 | A | 4/1999 |
| JP | 2010261130 | A | 11/2010 |

OTHER PUBLICATIONS

European Search Report dated Dec. 7, 2015 in Application No. 15275171.5, 9 pages.

(Continued)

*Primary Examiner* — Binu Thomas

(74) *Attorney, Agent, or Firm* — Shook, Hardy & Bacon L.L.P.

(57) ABSTRACT

An apparatus is provided for coloring threaded material. A payout support member of the apparatus is configured to support a payout spool. A drive member is configured to rotate a takeup spool. A coloring assembly comprises a colorant applicator holding portion that is configured to receive a colorant applicator. The coloring assembly also includes a passage configured to receive a thread and to dispose the thread against the colorant applicator as the thread is wound onto the takeup spool. The coloring assembly is positioned to direct the thread drawn through the passage toward a portion of the takeup spool.

30 Claims, 14 Drawing Sheets

(56) References Cited

U.S. PATENT DOCUMENTS

| | | | | |
|---|---|---|---|---|
| 3,667,203 | A | 6/1972 | Koschatzky et al. | |
| 3,749,055 | A * | 7/1973 | Benson | D06B 3/045 118/234 |
| 3,808,618 | A | 5/1974 | Arimoto et al. | |
| 4,502,409 | A * | 3/1985 | Perry | D06B 1/08 118/410 |
| 5,452,517 | A * | 9/1995 | Lothmann | H01B 13/00 118/255 |
| 7,001,465 | B1 * | 2/2006 | Thomas | B05C 3/125 118/420 |
| 2003/0224118 | A1 * | 12/2003 | Huang | B05B 13/0207 118/325 |
| 2004/0074220 | A1 | 4/2004 | Harmon | |
| 2012/0241546 | A1 * | 9/2012 | Shimp | B65H 54/106 242/419 |
| 2012/0244353 | A1 | 9/2012 | Wright | |

OTHER PUBLICATIONS

European Search Report Dated May 31, 2016 for European Patent Application No. 15275172.3, 9 Pages.

* cited by examiner

THREAD COLORING APPARATUS

CROSS-REFERENCE TO RELATED APPLICATIONS

The present application is a continuation-in-part of U.S. patent application Ser. No. 14/490,314, filed Sep. 18, 2014, entitled "Threading Apparatus," which claims priority to UK Patent Application GB1412502.5, filed Jul. 14, 2014, entitled "Threading Apparatus," both of which are incorporated herein by reference in their entireties. The present application also claims priority to UK Patent Application GB 1505044.6, filed Mar. 25, 2015, entitled "Thread Colouring Apparatus," which is incorporated herein by reference in its entirety.

SUMMARY

A high-level overview of various aspects of the invention are provided here for that reason, to provide an overview of the disclosure and to introduce a selection of concepts that are further described in the detailed-description section below. This summary is not intended to identify key features or essential features of the claimed subject matter, nor is it intended to be used as an aid in isolation to determine the scope of the claimed subject matter. In brief and at a high level, this disclosure describes, among other things, ways to provide a thread coloring apparatus.

BRIEF DESCRIPTION OF THE SEVERAL VIEWS OF THE DRAWINGS

Illustrative embodiments of the present invention are described in detail below with reference to the attached drawing figures, and wherein.

DETAILED DESCRIPTION

Figure 1:
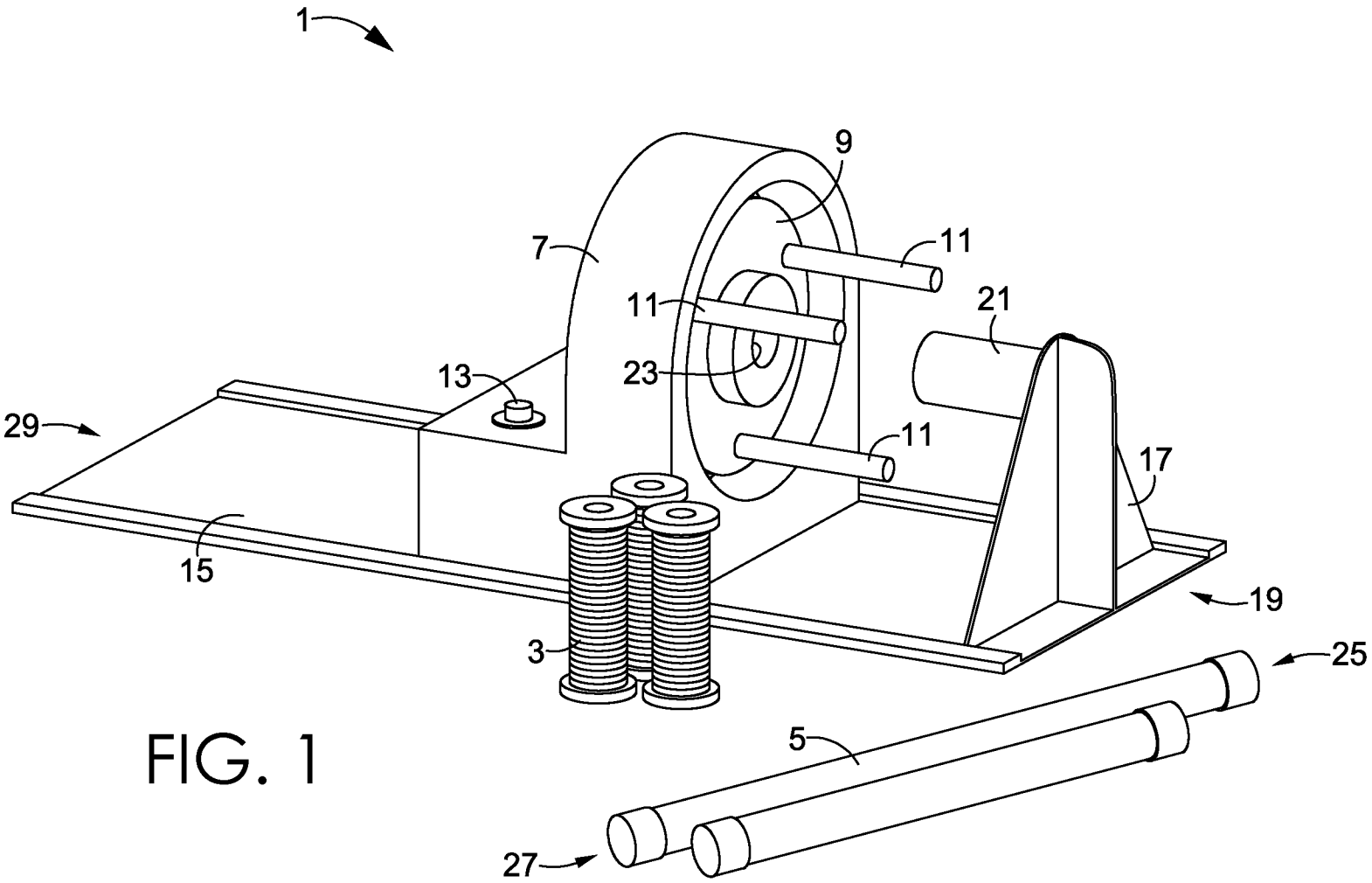
FIG. 1 illustrates an apparatus in accordance with an embodiment of the present invention.

The subject matter of select embodiments of the present invention is described with specificity herein to meet statutory requirements. But the description itself is not intended to define what is regarded as an embodiment of the invention, which is what the claims do. The claimed subject matter may be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Although the following description refers to a children's toy in the form of a thread-wrapping machine and a thread-coloring apparatus, a person skilled in the art will appreciate that the present invention could also be used for other threading, winding, and/or coloring purposes.

Children's toys enabling the user to thread and/or lace a plurality of articles together to form bracelets/anklets/ necklaces and/or the like have been known for some time. They can be provided in various forms, for example, some are provided with a single piece of thread, lace, and so forth, on which charms and other decorative articles are threaded, creating a custom necklace, bracelet, or anklet. Alternatively, a user may wish to create a customized bracelet, often termed a "friendship bracelet." This may involve intertwining a number of different threads about each other in order to create a more intricate design. Charms and other decorative articles may be added again in order to further customize the bracelet. Often, the children constructing jewelry items such as these will do so with their hands, and the process can be quite time consuming.

It is therefore an aim of the present invention to provide an apparatus for creating various threaded articles that overcomes the aforementioned problems. It is a further aim of the present invention to provide a method of thread-wrapping to create a threaded article overcoming the problems associated with the prior art.

According to a first aspect of the invention there is provided an apparatus for forming at least one threaded member, said apparatus including: a rotatable member; at least one holding member protruding from said rotating member; said at least one holding member having at least one spool and/or the like of a threaded material located thereon, wherein said at least one holding member is offset to the axis of rotation of the rotating member such that upon rotation of said rotating member, the said threaded material is wrapped around an article provided with the apparatus.

In one embodiment, the article being wrapped is substantially mounted along the axis of rotation of the rotatable member. In another embodiment, the rotatable member is mounted for rotation in a housing and the housing includes means to allow the powered or manual movement of the rotatable member. In a further embodiment, the rotatable member has two or more holding members that are spaced apart. Each of the holding members may be offset from the axis of rotation, and each may receive a spool or the like thereon.

Some embodiments of said apparatus may be provided with a base portion. A support portion may also be provided on said base portion. Further, the article may be located on said support portion.

In one embodiment, said housing is movable on said base portion. As such, said housing may be movable relative to a support portion located on said base portion. Further, said support portion may be fixed relative to said base portion. In another embodiment, the housing may be provided integral with the base portion and movable thereon with respect to the support portion. In further embodiments, said housing is detachably attached to a base portion.

The rotating member may be provided with an aperture located therein. The aperture may be located in a substantially central position on said rotating member, according to some aspects. Further, the aperture may be sized to receive said article. In one embodiment, said article, located on said support portion, is received through said aperture upon movement of said housing along said base portion and towards said support portion. In another embodiment, rotation of said rotating member is actuated by one or more activation means. Such activation means may be the form of a switch means.

In one embodiment, rotation of said rotating member rotates said holding members about said article. In another embodiment, three or more holding members are provided on said rotating member.

The article may be provided as a tubular member, having first and second ends. On one example, a first end of said article is detachably attached to a support portion.

In one embodiment, said two or more holding members, each having at least one spool and/or the like of a threaded material located thereon, are located radially outward of a centrally located aperture on said rotating member. A first end of the threaded material may be attached to a first end of said article. In one aspect, a first end of threaded material of each spool and/or the like of threaded material on each holding member may be attached to a first end of said article.

In another embodiment, said rotating member rotates said two or more holding members and hence said spools and/or the like of threaded material about said article, causing two or more strands of threaded material to simultaneously wrap about said article. In one aspect, rotation of said rotating member continues until said article is wrapped in threaded material to an extent selected by the user.

In one embodiment, a cover means is provided on said apparatus. Typically, said cover means acts as a protective guard against rotating components of the apparatus. Further, said cover means may include an aperture located substantially opposite an aperture on said rotating member. As such, said article may be sized to be received through each of said apertures. In one embodiment, wrapping of said threaded material about said article occurs within said cover means. In a further embodiment, said cover means is provided as a substantially transparent casing.

According to one aspect of the invention, two or more guide means are provided on said rotating member, associated with said two or more holding members. In one embodiment, said guide means are provided with an aperture located therein. Further, said threaded material associated with each of said two or more holding members may be received through the aperture located on the associated guide means.

In one embodiment, said article is located on a support portion. Such support portion may be separate from said apparatus. In one embodiment, said support portion may include a first face and a second, opposing face.

Accordingly, one embodiment of the invention includes a plate member located on said first face of said support portion. The plate member may be rotatable with respect to the support portion. Further, the plate member may be detachably attachable to said two or more holding members. In one aspect of the invention, rotation of said plate member is actuated by rotation of said rotating member.

In one embodiment, said plate member includes an aperture located thereon. Said aperture may be located centrally of said plate member. Further, said aperture may be sized to receive threaded material according to one embodiment.

In one embodiment, said support portion includes an aperture located thereon. Such support portion aperture may be located substantially in line with the aperture located on said plate member. Further, the aperture on the support portion may be sized to receive threaded material.

In one embodiment, said article is located on said second face of said support portion. The article may be detachably attached to the support portion's second face. In another embodiment, said article is rotatable with respect to said support portion. Rotation of said article may be actuated by rotation of said rotating member. Further, said article may rotate at a slower angular velocity than that of said rotating member.

In one embodiment, guide means are located on said second face of said support portion. Such guide means may be provided with an aperture located therein. In one aspect, a first end of two or more spools of threaded material, located on said two or more holding members, is fed, in series, through associated guide means, through apertures located on said plate member and said support portion, through guide means located on said second face of said support portion, and attached to a first end of said article.

Rotation of said rotating member causes the threaded material of the two or more spools to intertwine, according to one embodiment. Such threaded material may be subsequently wrapped about said article. Further, said threaded material, wrapped about said article, may comprise two or more individual strands of threaded material, creating a composite thread. In another aspect, said composite thread is removable from said article.

A means for changing the color of the thread may be included with said apparatus, according to one embodiment. Such means may be provided to alter the pigment of one or more strands of said threaded material. Further, such means may be provided to dye said one or more strands of threaded material prior to wrapping said thread material about said article.

In a further aspect of the present invention, an apparatus for forming at least one threaded member about an article is provided. The apparatus may include: a rotating member; and two or more holding members protruding from said rotating member, said two or more holding members each having at least one spool and/or the like of a threaded material located thereon. Upon rotation of said rotating member, two or more strands of threaded material associated with the two or more holding members may be simultaneously wrapped around said article.

In one embodiment, said article having said two or more strands of threaded material wrapped therearound may form at least a part of an item of jewelry, children's jewelry and/or the like.

In yet a further aspect of the present invention an apparatus is provided for forming at least one threaded member, said apparatus including: a rotating member; and two or more holding members protruding from said rotating member, said two or more holding members each having at least one spool and/or the like of a threaded material located thereon, wherein upon rotation of said rotating member, two or more strands of threaded material associated with the two or more holding members simultaneously wrap about each other and subsequently around said article.

In one embodiment, said threaded member is a composite of two or more strands of threaded material. Said threaded member may be removed from said article to form an item of jewelry, children's jewelry and/or the like, according to one embodiment.

In one embodiment, two or more guide means are provided on said rotating member, associated with said two or more holding members. Such guide means may be provided with an aperture located therein. Further, said threaded material associated with each of said two or more holding members may be received through the aperture located on the associated guide means.

In yet a further aspect of the present invention, a method of forming at least one threaded member about an article is provided. Said method includes the steps of: providing an apparatus including a rotating member; providing at least one holding member protruding from said rotating member; providing on said at least one holding member at least one spool and/or the like of a threaded material located thereon; connecting the end of the threaded material to a first end of said article; and rotating said rotating member such that said threaded material wraps around said article.

In another aspect of the present invention, a method of forming at least one threaded member includes the steps of: providing an apparatus including a rotating member; two or more holding members protruding from said rotating member, said two or more holding members each having at least one spool and/or the like of a threaded material located thereon; guide means associated with each of said two or more holding members; feeding ends of two or more strands of threaded material associated with the two or more holding members through apertures located on said guide means and connecting the same to a first end of an article, said article located on a support portion attachable to said apparatus; and attaching said support portion to said apparatus, and wherein upon rotation of said rotating member, said strands of threaded material associated with the two or more holding members simultaneously wrap about each other and subsequently around said article, forming a threaded member that is a composite of two or more strands of threaded material.

In one embodiment, an apparatus for coloring threaded material includes a drive member configured to rotate a takeup spool, and a primary thread guide that includes a passage configured to guide a threaded material as the threaded material is wound onto the takeup spool. The primary thread guide also includes a receptacle adapted to receive a marking device. The receptacle is configured to dispose a colorant-delivering portion of the marking device against the threaded material.

In another embodiment, an apparatus for coloring threaded material includes a payout support member configured to support a payout spool, a drive member configured to rotate a takeup spool, and a coloring assembly. The coloring assembly includes a colorant applicator holding portion configured to receive a colorant applicator, and a passage configured to receive a thread and to dispose the thread against the colorant applicator as the thread is wound onto the takeup spool. The coloring assembly is positioned to direct the thread drawn through the passage toward a portion of the takeup spool.

In yet another embodiment, an apparatus for coloring a thread material includes a housing and a rotatable member mounted in the housing. The housing includes a drive that rotates the rotatable member. A holding member protrudes from the rotatable member, and the holding member is configured to receive a takeup spool. A payout support member is configured to rotatably support a payout spool that includes the thread material. The apparatus further includes a primary thread guide that includes a passage configured to receive the thread material. The primary thread guide is positioned to direct the thread material toward a portion of the takeup spool as the thread material is unwound from the payout spool and wound onto the takeup spool. The primary thread guide also includes a receptacle adapted to receive a marking device. The passage is configured to dispose the thread material against a colorant delivering portion of the marking device. The apparatus also includes a payout thread guide configured to guide the thread material toward the primary thread guide as the thread material is unwound from the payout spool.

Figure 2:
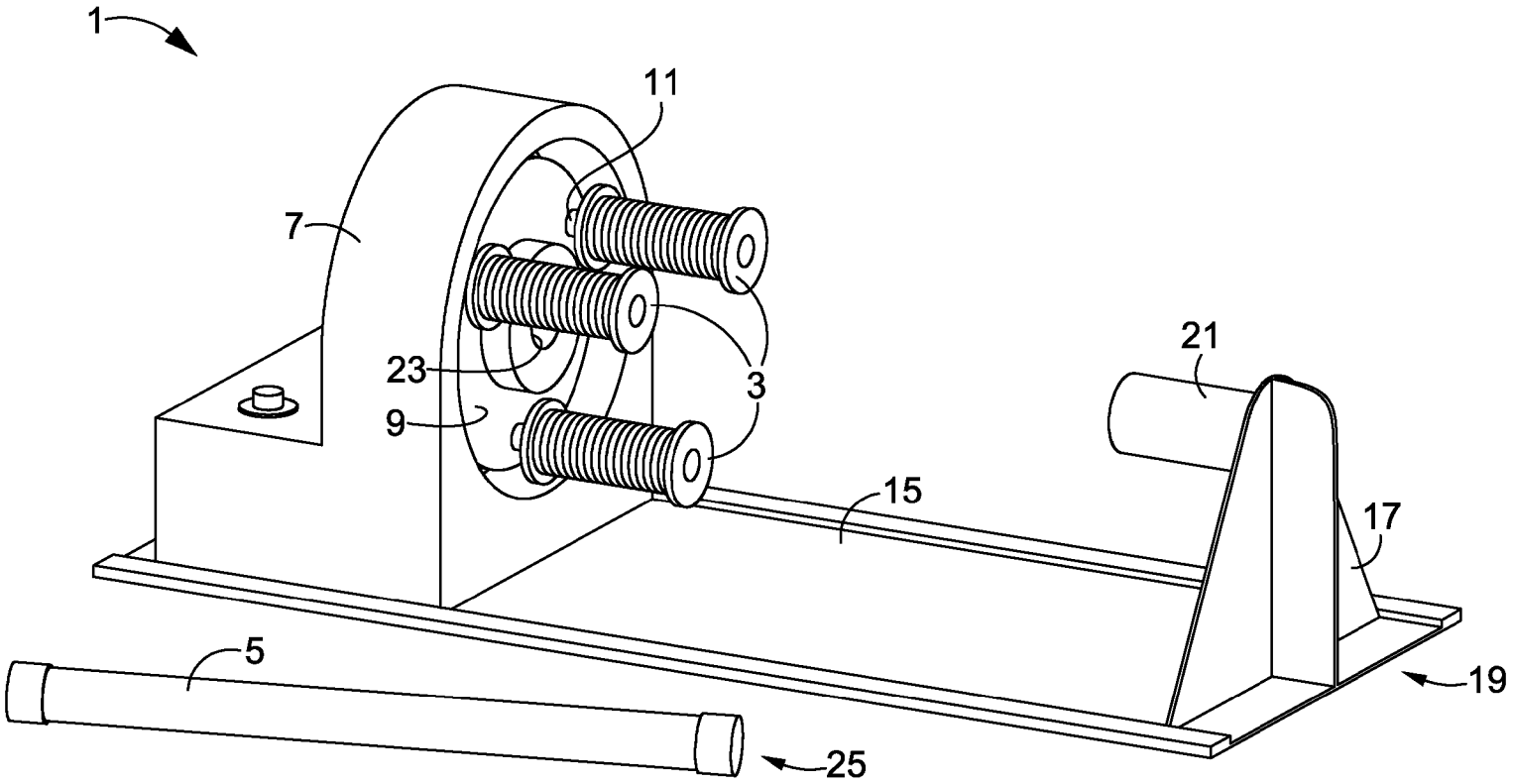
FIG. 2 illustrates an apparatus with spools of threaded material affixed thereto, in accordance with another embodiment of the present invention.
Figure 3:
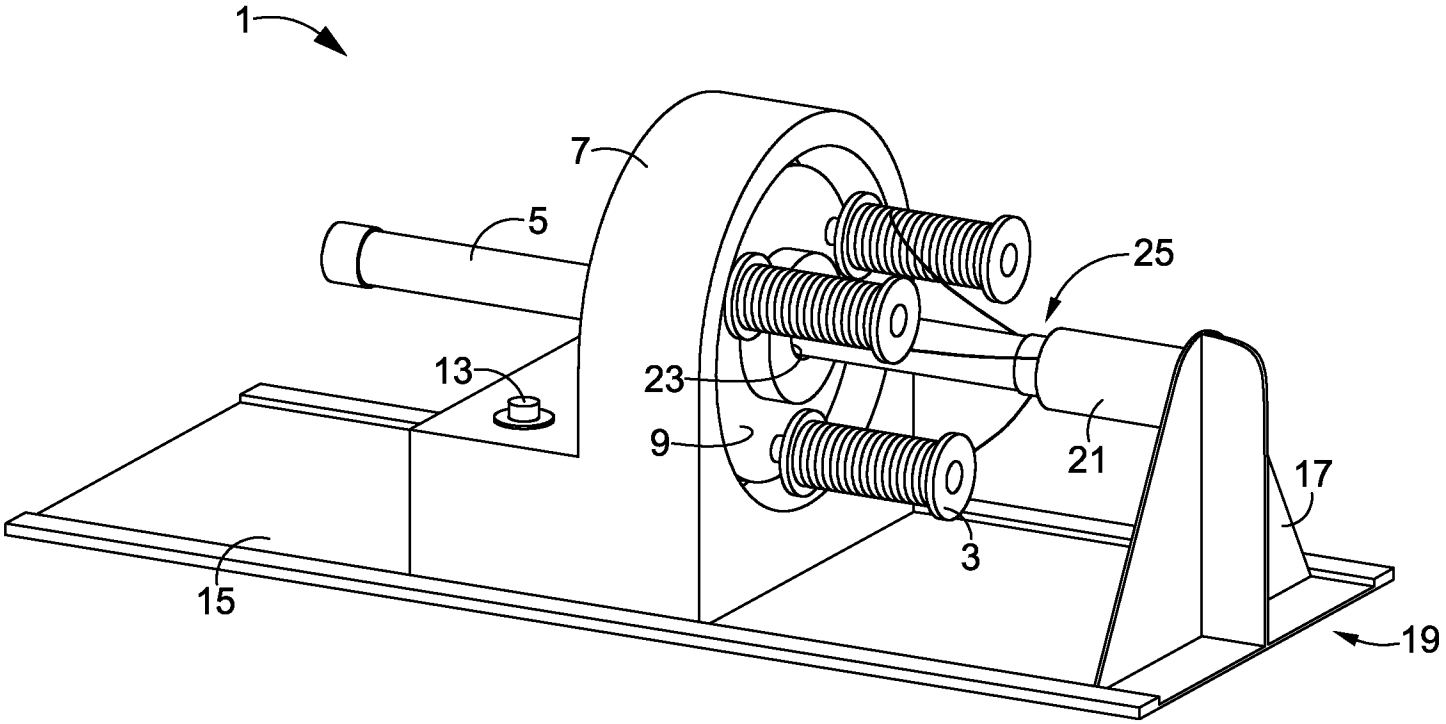
FIG. 3 illustrates an apparatus with spools of threaded material and an article affixed thereto, in accordance with another embodiment of the present invention.

Referring initially to FIGS. 1-3, an embodiment of an apparatus in the form of a thread-wrapping machine 1 is provided to enable thread from a number of spools 3 to be simultaneously wrapped about an article 5. The thread-wrapping machine 1 may include a housing 7 in which a rotating member in the form of a disc 9 is located. In this embodiment, the disc 9 has a number of holding members in the form of spool holding bars 11 protruding outwardly therefrom, on which the spools 3 may be placed. Although the present example illustrates three holding bars 11 on the disc 9, one skilled in the art will appreciate that this number may vary depending on the specifications of the thread wrapping machine 1. Rotation of the disc 9 is activated by switch 13 located on the housing 7 of the apparatus 1, according to one embodiment. The housing 7 of the apparatus 1 is located on a base 15 and may be movable therealong relative to a supporting portion 17, located at an end 19 of the base 15 that is fixed in position on the base 15, in one aspect. A support bar 21 is provided on the supporting portion 17, protruding outwardly therefrom toward the housing 7, as shown in FIG. 1. A central hole 23 formed in the rotating disc 9 extends through the housing 7 of the apparatus 1. In some embodiments, the hole 23 is located substantially in line with the support bar 21.

A first end 25 of the article 5 about which thread is to be wrapped may be attached to the support bar 21. In some embodiments, the article 5 has a maximum radius sized to fit through the hole 23 in the housing 7 and once located on the support bar 21, a second end 27 of the article 5 extends through the hole 23, allowing the housing 7 to move back and forth along the base 15 with the article 5 sliding through the hole 23. With the spools 3 located on their respective holding bars 11, the ends of each strand of thread may be taken and attached to the first end 25 of the article 5, with the housing 7 located in close proximity to the supporting portion 17 initially. Once the thread ends are attached to the article 5, the switch 13 is activated, causing the disc 9, and consequently the holding bars 11 and spools 3, to rotate about the article 5, according to one embodiment. During rotation, thread is unwound from the spools 3 forming a layer of multiple strands of thread simultaneously wrapped about the article 5. As the article 5 is wrapped with thread, the housing 7 is moved gradually away from the supporting portion 17 along the base, thereby exposing more of the article 5 to be wrapped. In one embodiment, the spools 3 of thread may be provided in various colors, resulting in a varying range of colors and/or patterns of thread wrapped about the article 5. Once the article 5 has been wrapped/covered in thread to a sufficient degree or to a user's satisfaction, rotation of the disc 9 may be ceased via the switch 13, and the housing 7 may be moved to a distal end 29 of the base away from the supporting portion 17, thereby allowing the article 5, now wrapped in multiple strands of thread, to be removed from the support bar 21. In one embodiment, the article 5 may subsequently be used as an item of novelty/children's jewelry, or as an accessory/attachment to an item of children's jewelry.

In the exemplary embodiment, the housing 7 of the thread-wrapping machine 1 is movable along the base portion 15 with respect to the supporting portion 17. In further embodiments, it may also be detachably attached thereto, allowing a user to remove the housing 7 for maintenance, repair, or even use without the need for the base 15 or supporting portion 17.

Figure 4:
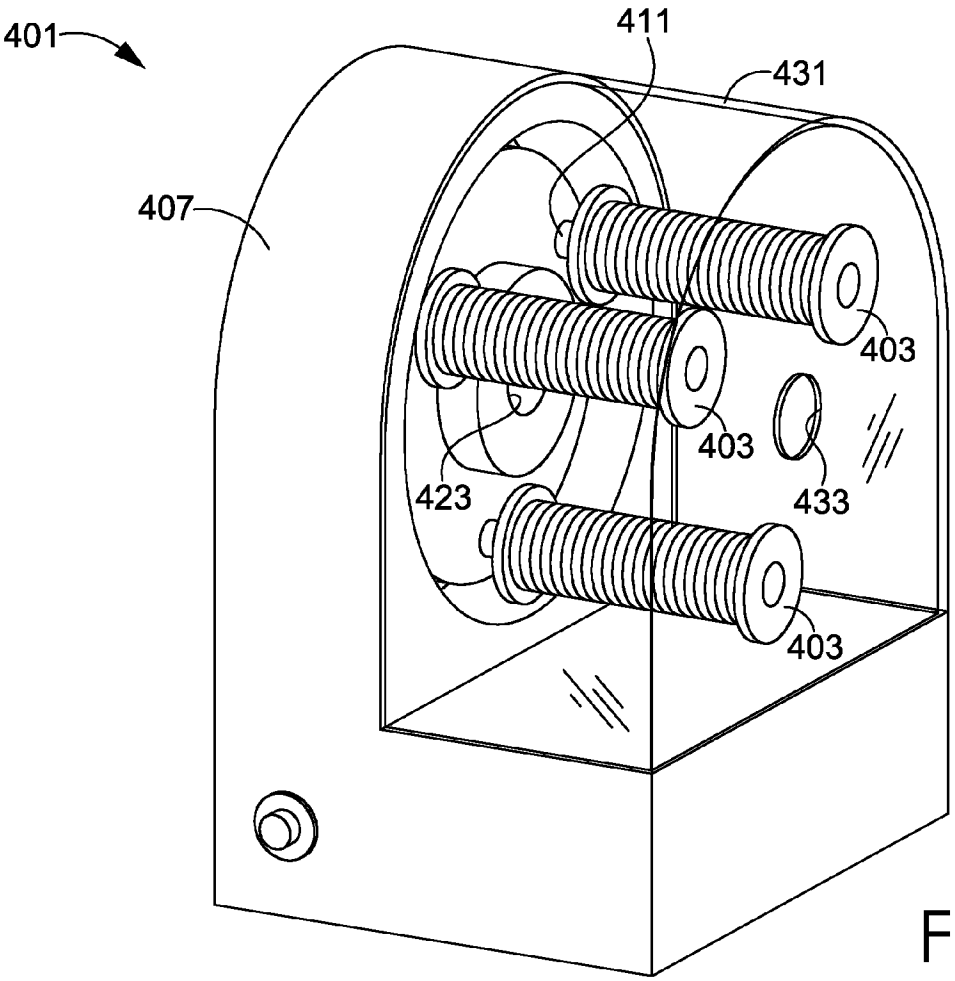
FIG. 4 illustrates an apparatus having a cover means in accordance with an embodiment of the present invention.
Figure 5:
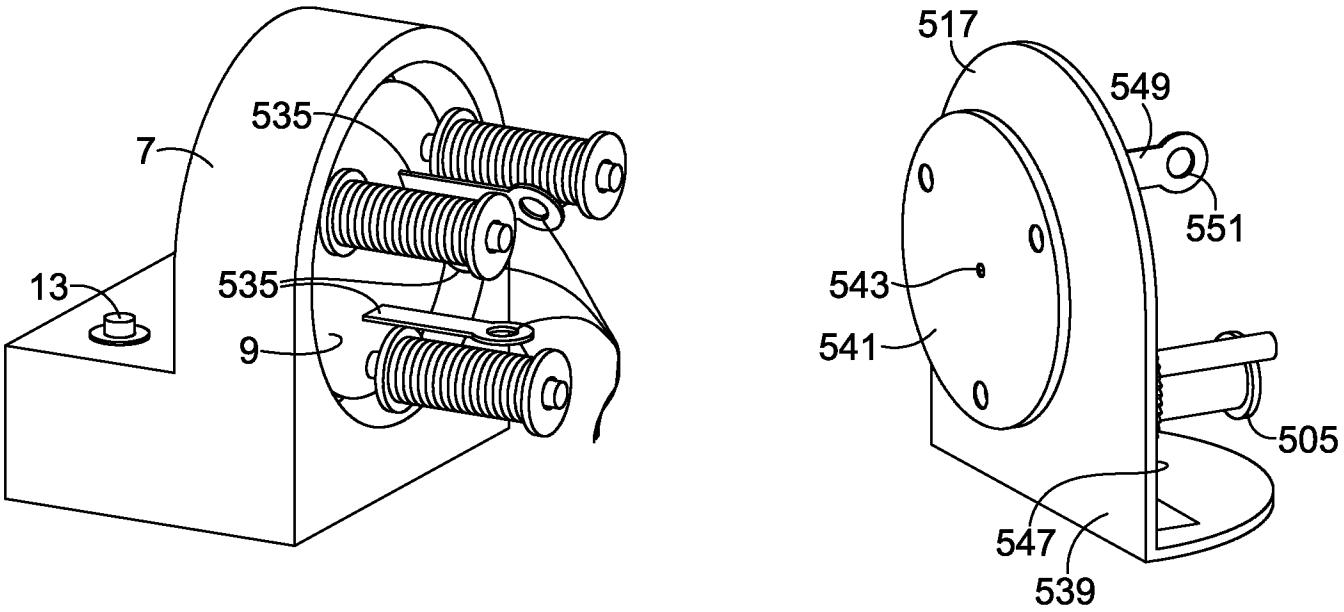
FIG. 5 illustrates an apparatus and support portion in accordance with an embodiment of the present invention.
Figure 6:
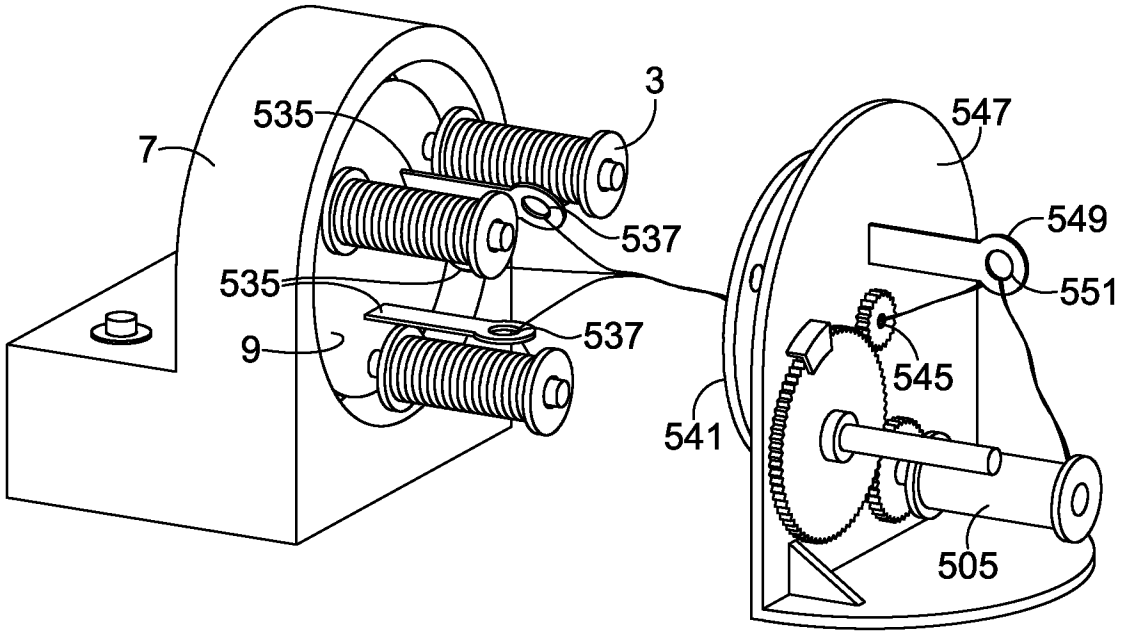
FIG. 6 illustrates an apparatus and support portion with threaded material fed therethrough, in accordance with an embodiment of the present invention.
Figure 7:
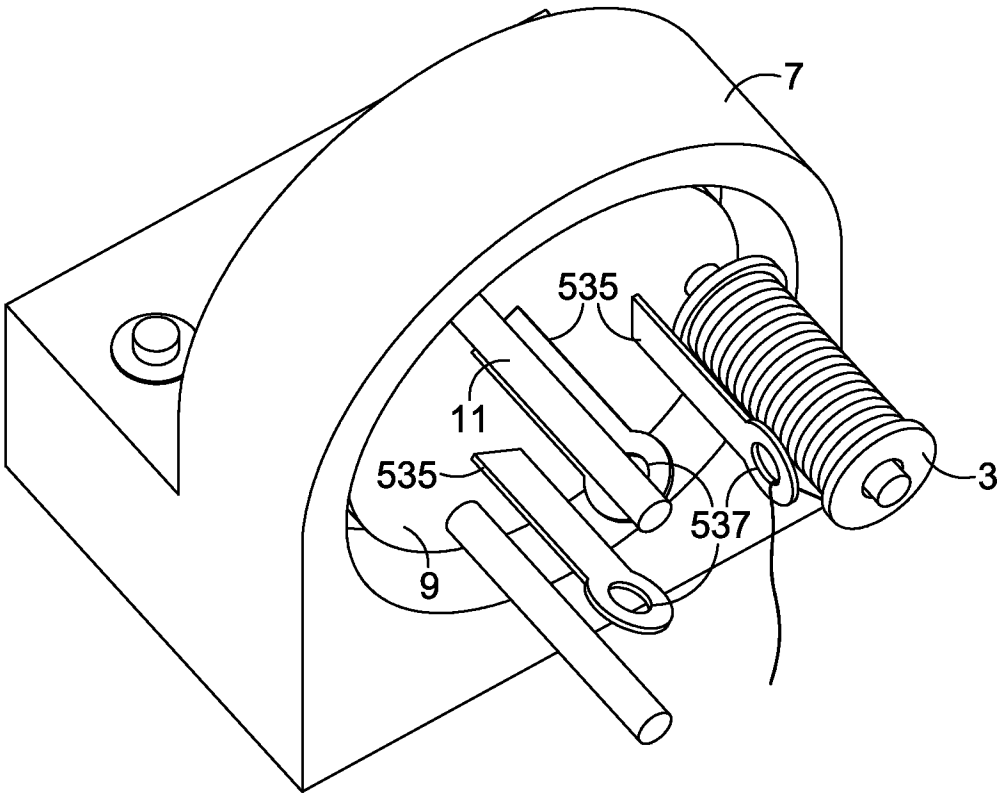
FIG. 7 illustrates an enlarged view of an apparatus in accordance with an embodiment of the present invention.
Figure 8:
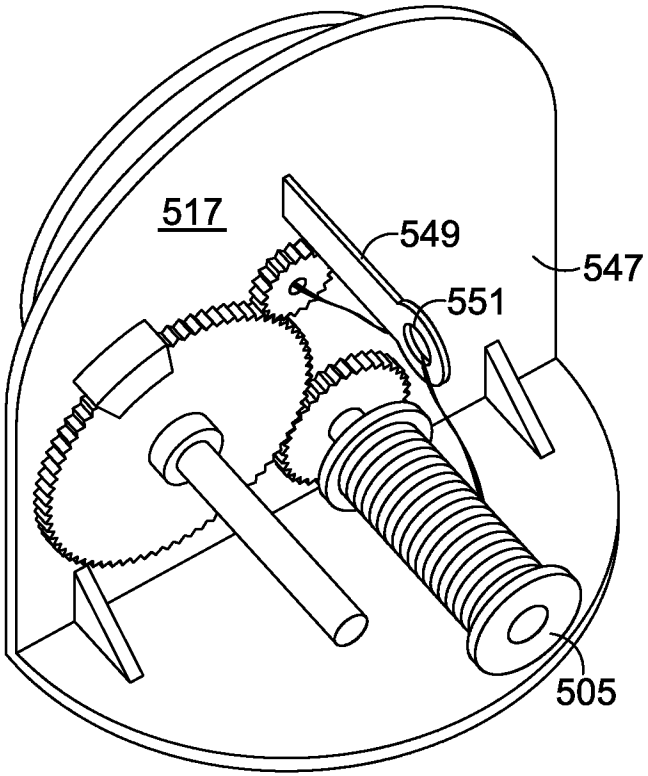
FIG. 8 illustrates an enlarged view of a support portion of an apparatus in accordance with an embodiment of the present invention.
Figure 9:
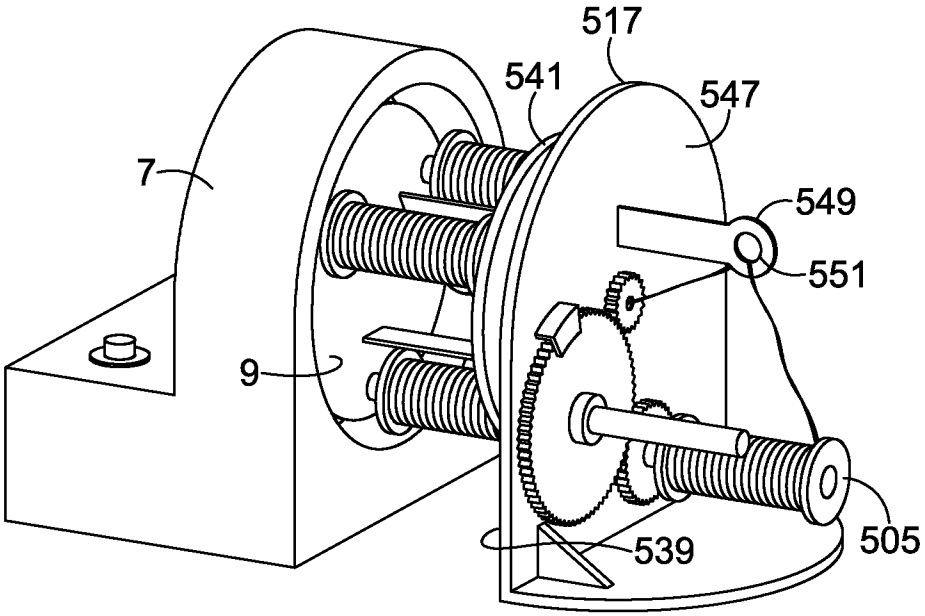
FIG. 9 illustrates an apparatus and support portion connected and in use, in accordance with an embodiment of the present invention.

FIG. 4 illustrates an alternative embodiment of the thread-wrapping machine 401, which includes a protective cover 431 located thereon. The cover 431 encases the holding bars 411 and, hence, the spools 403 thereby preventing any fast-moving parts from becoming detached from the apparatus while moving and causing injury to a user. In one embodiment, in order for an article to be wrapped when the apparatus 401 is presented in this form, the cover 431 includes a hole 433 located on its face opposite the central hole 423 of the housing 407. In this embodiment, a user may hold the article (not shown) as it passes through the holes 433, 423 and is wrapped in thread. The cover 431 may also be provided as a transparent body, enabling the user to view the progress of the thread-wrapping action.

Referring now to FIGS. 5-9, a housing 7 of the thread-wrapping machine 1 depicted in FIGS. 1-3 is provided. In this particular embodiment, the housing 7 has been detached from the base portion 15. Guide means 535 are affixed to the rotating disc 9, each of which is associated with a corresponding holding bar 11, and located radially between each holding bar 11 and the central hole 23. Each guide means 535 includes a guide hole 537 through which thread from each spool 3 is fed. Such a feature allows the individual thread strands to be combined and, upon rotation of the disc 9, intertwined, thereby creating a composite thread made from two, three or potentially more individual strands of thread.

In alternative embodiments, an alternative supporting portion 517 is provided, which includes two faces 539 and 547. The first face 539 includes a plate 541, which is rotatable with respect to the supporting portion 517. The plate 541 may be attached to the holding bars 11 of the housing 7 or spools 3 located thereon. Such an attachment provides a connection between the supporting portion 517 and the housing 7 of the apparatus 1, such that upon rotation of the disc 9, the plate 541 is caused to rotate at the same angular velocity. The plate 541 may include a hole 543 located centrally thereon and in line with the hole 23 of the rotating disc 9, and a further hole 545 located on the supporting portion 517 extending through its first face to a second and opposing face 547. The holes 543, 545 are sized to allow strands of thread to pass therethrough. In one aspect, an alternative article 505 is located on the second face 547 of the supporting portion 517. The article 505 may be detachably attached to the supporting portion and, while attached, is rotatable with respect to the sporting portion 517. Rotation of the article 505 is actuated by rotation of the disc 9 and, consequently, the plate 541. However, the article 505 is arranged to rotate at a slower angular velocity than that of the disc 9 and the plate 541. Additional guide means 549 is provided on the second face 547 of the supporting portion 517 having a guide hole 551 located therein. The guide means 549 allows thread, which has been fed through guide holes 537 and subsequently holes 543, 545 in the plate 541 and supporting portion 517, to be fed through its guide hole 551 and finally attached to a first end 525 of the article 505. As the switch 13 is activated and the disc 9 rotates, the strands of thread from each spool 3 begin to intertwine with one another and are slowly fed onto and wrap around the article 505, creating a composite thread formed from multiple individual strands of thread. In one embodiment, if several lengths of composite thread are formed, these can be put through the same process as the spools 3 of individual thread, thereby creating a secondary composite thread, and so on. Once wrapping of the thread about the article 505 is complete, the composite thread may be removed and used as an item of children's jewelry, such as a necklace, bracelet, friendship bracelet, anklet and/or the like.

Additionally, a dying apparatus such as a marker (not shown) may be affixed to the apparatus and arranged so as to color and/or recolor one or more of the strands of thread as they unwind from their respective spools. This feature may be added to alter the color of a particular thread prior to it being intertwined with other thread strands and/or being wrapped about the article. For example, a user may affix a spool of white thread and wish to color it prior to wrapping. This may be achieved by the provision of an appropriately colored marker located in position on the apparatus. Several locations for markers may be provided so a user can, if they choose, color each spool of thread that is place on the holding bars of the thread-wrapping machine.

Figure 10:
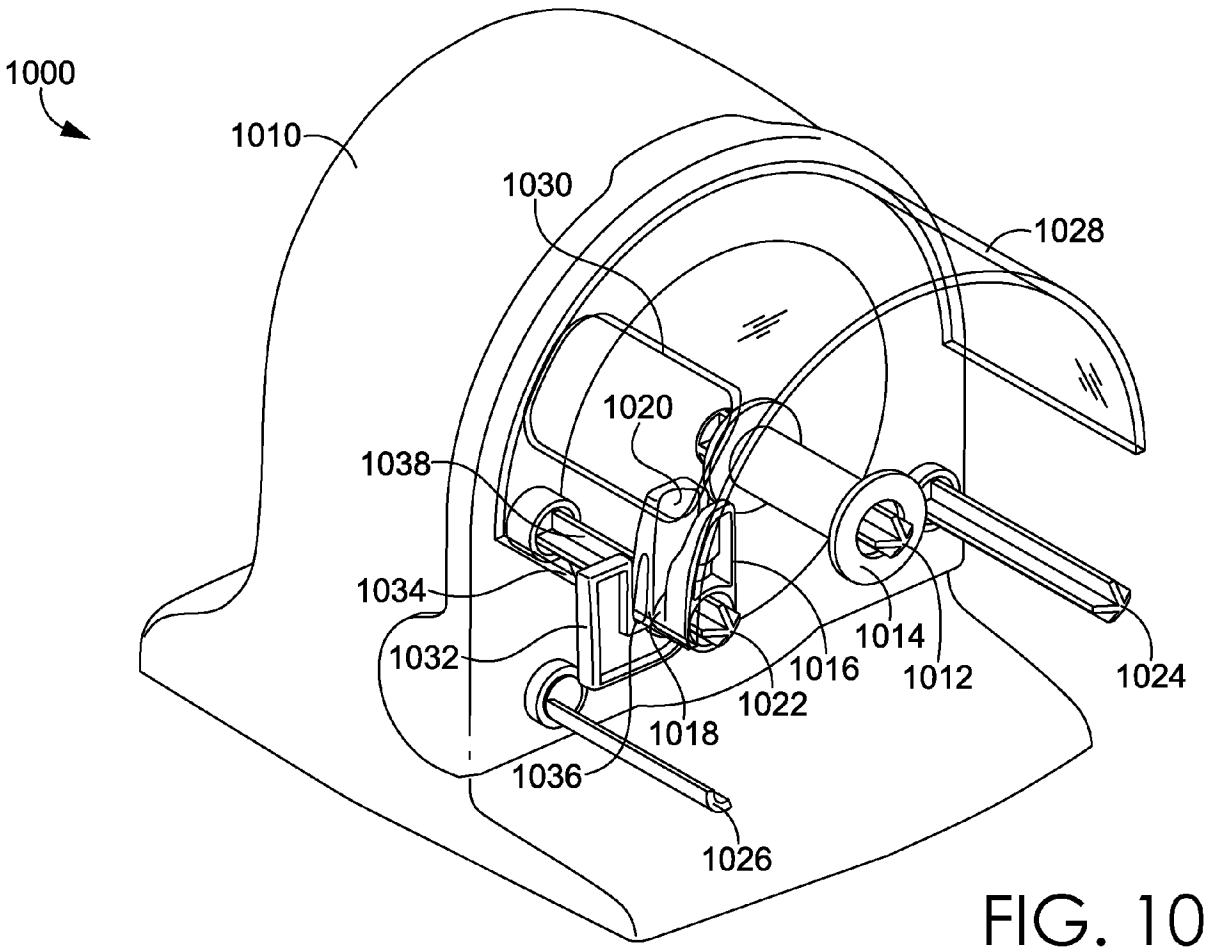
FIG. 10 illustrates an exemplary apparatus for coloring a threaded material in accordance with an embodiment of the invention.

Referring now to FIG. 10, an exemplary apparatus for coloring a threaded material is depicted, and is generally referred to as apparatus 1000. Apparatus 1000 is but one example of a suitable apparatus, and is not intended to suggest any limitation as to the scope of use or functionality of embodiments of the invention. Neither should apparatus 1000 be interpreted as having any dependency or requirement relating to any single component or combination of components illustrated therein.

In one embodiment, apparatus 1000 includes a housing 1010 that includes or encloses a rotatable member (not shown), and which includes a drive (not shown) that rotates the rotatable member. The drive may be powered, such as by electricity, a windup mechanism, and so forth, or may be manually driven such as by a knob, crank, or lever, among others. Apparatus 1000 also includes a holding member 1012 that protrudes from the rotatable member, which is configured to receive a takeup spool 1014. In an embodiment, holding member 1012 includes a longitudinal shaft having a cross section that matches a cross section of a hole in the center of takeup spool 1014, such that the spool rotates with holding member 1012. In another embodiment, holding member 1012 utilizes a gripping portion (not shown) that removably engages an end of takeup spool 1014. Non-limiting examples of the gripping portion include a circular recess, prongs, jaws, magnetic couplings, and so forth.

Apparatus 1000 also includes a primary thread guide 1016 that includes a passage 1018 through which the threaded material (not shown) is drawn as the threaded material is wound onto takeup spool 1014, and which directs the threaded material toward takeup spool 1014, according to one embodiment of the invention. Primary thread guide 1016 also includes a receptacle 1020 that is configured to receive and hold a colorant applicator or marker, such as a felt-tipped marker. Passage 1018 is positioned such that the threaded material is held against the marking portion (e.g., the tip) of the inserted marker as the threaded material is drawn through passage 1018. In the exemplary embodiment of FIG. 10, primary thread guide 1016 is mounted on a primary guide support member 1022. In an embodiment, primary guide support member 1022 includes a shaft 1038 on which primary thread guide 1016 is movably mounted, such that primary thread guide 1016 is slidable back and forth along the shaft 1038 of primary guide support member 1022. The movement of primary thread guide 1016 causes the threaded material to be directed to different portions along takeup spool 1014. For example, moving primary thread guide 1016 back and forth causes the threaded material to be wound more evenly on takeup spool 1014. Primary thread guide 1016 may also be affixed to a movable member of primary guide support member 1022, such that the movable member enables primary thread guide 1016 to be moved.

Apparatus 1000 also includes a payout support member 1024 configured to rotatably support a payout spool (not shown) that holds the threaded material to be colored. In an embodiment, payout support member 1024 includes a fixed shaft on which the payout spool rotates freely. In another embodiment, the shaft of payout support member 1024 may be rotatable, such that the shaft and payout spool rotate together. In another embodiment, payout support member 1024 utilizes a rotatable gripping portion that removably engages an end of the payout spool. Examples of a gripping portion include, but are not limited to, a circular recess, prongs, jaws, magnetic couplings, and so forth. Apparatus 1000 also includes a payout thread guide 1026 configured to guide the threaded material toward primary thread guide 1016 as the threaded material is unwound from the payout spool.

Apparatus 1000 also includes a cover 1028 attached to the housing, which at least partially encases or covers holding member 1012, primary guide support member 1022, primary thread guide 1016, payout support member 1024, and/or payout thread guide 1026. Cover 1028 is generally positioned between a user and the moving components of apparatus 1000 and serves as a protective shield. Cover 1028 may be at least partially transparent. A portion of cover 1028 forms an aperture 1030 positioned above primary thread guide 1016 such that a marker (not shown) may pass through aperture 1030 when inserted into receptacle 1020 of primary thread guide 1016. In an embodiment, the dimensions of aperture 1030 are such that the perimeter of aperture 1030 does not interfere with movement of the marker, which moves with primary thread guide 1016. In an embodiment, the dimensions of aperture 1030 are such that the perimeter of aperture 1030 limits movement of the marker and primary thread guide 1016 within a range that corresponds to the central winding portion of takeup spool 1014. This ensures that primary thread guide 1016 cannot be moved far enough in either direction to guide the threaded material off the end of takeup spool 1014. In an embodiment, movement of primary thread guide 1016 corresponds to manual movement of the marker by the user holding the marker, including moving the marker back and forth as the thread is wound onto takeup spool 1014. In an embodiment, the movement of primary thread guide 1016 is automatic. In another embodiment, a portion 1032 of primary thread guide 1016 extends beyond cover 1028 and may be used as a handle by the user to move primary thread guide 1016 with respect to primary guide support member 1022. As depicted in FIG. 10, portion 1032 of primary thread guide 1016 extends beneath a lower edge 1034 of cover 1028 and includes a notch 1036 that engages the lower edge 1034 of cover 1028.

Figure 11:
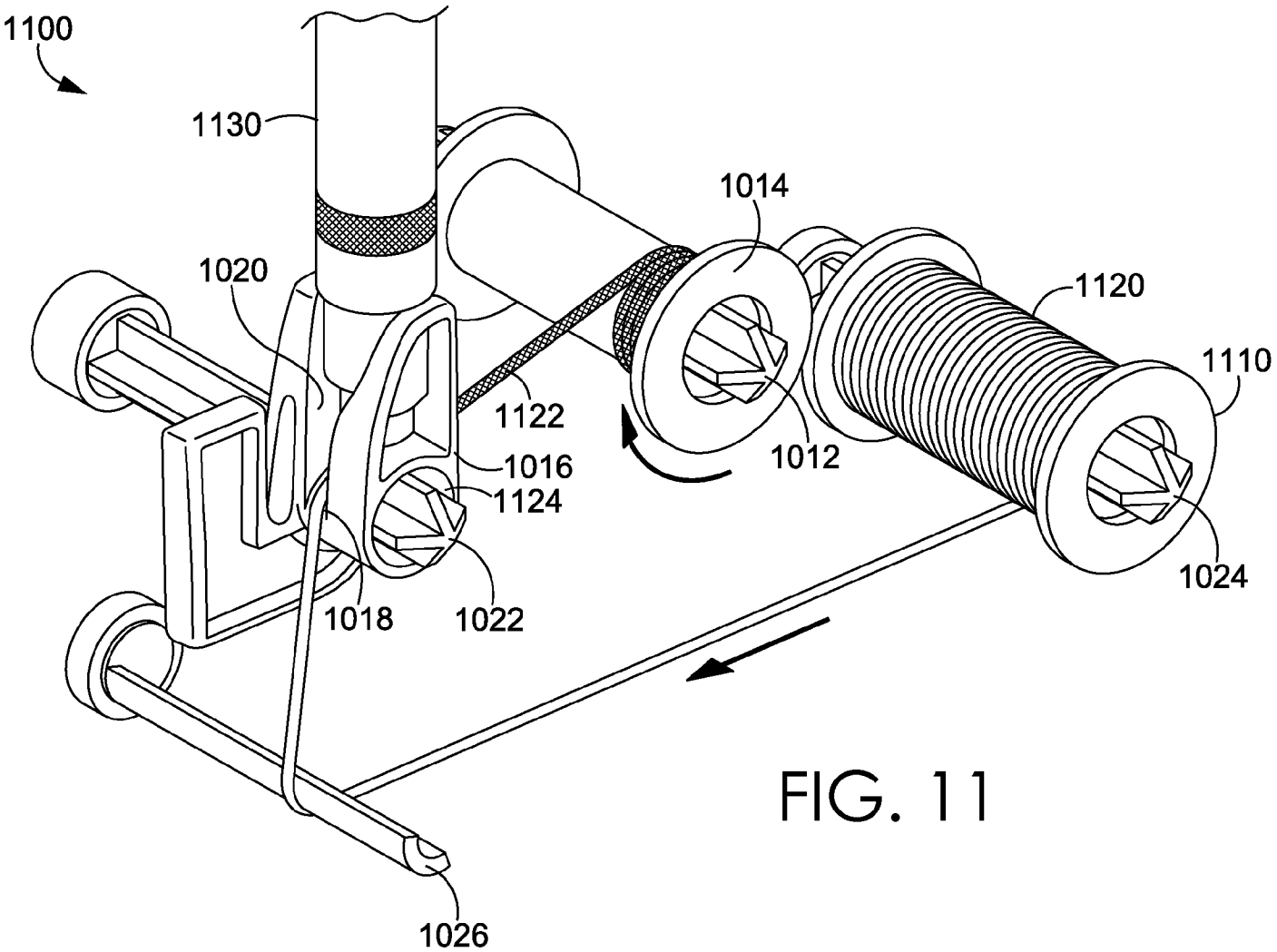
FIG. 11 illustrates an enlarged portion of an exemplary apparatus for coloring a threaded material in accordance with an embodiment of the invention.

Referring now to FIG. 11, an enlarged portion of an embodiment of apparatus 1000 is depicted and is generally referred to as apparatus portion 1100. Apparatus portion 1100 is but one example of a suitable portion of apparatus 1000, and is not intended to suggest any limitation as to the scope of use or functionality of embodiments of the invention. Neither should apparatus portion 1100 be interpreted as having any dependency or requirement relating to any single component or combination of components illustrated therein.

Apparatus portion 1100 includes holding member 1012, takeup spool 1014, primary thread guide 1016, primary guide support member 1022, payout support member 1024, and payout thread guide 1026, which are described above with regard to FIG. 10. Also depicted is a payout spool 1110 rotatably supported by payout support member 1024. Payout spool 1110 is wound with a thread 1120 to be colored. Thread 1120 passes around payout thread guide 1026, passes through passage 1018 in primary thread guide 1016, and is wound onto takeup spool 1014, according to one embodiment.

As depicted, a marker 1130 is inserted into receptacle 1020 of payout thread guide 1026. As described above with regard to FIG. 10, passage 1018 is positioned such that thread 1120 is held against the marking portion (e.g., the tip and/or nib) of marker 1130. In an embodiment, as takeup spool 1014 rotates in a clockwise direction with respect to a central axis of the holding member 1012, thread 1120 is unwound from payout spool 1110 in a clockwise direction with respect to a central axis of payout support member 1024, is drawn through passage 1018 in primary thread guide 1016, and is wound onto takeup spool 1014. Additionally, based on positioning of a marker 1130 within the receptacle 1020, thread 1120 is drawn through passage 1018 and colorant from the marking portion of marker 1130 is deposited onto the thread. For example, a saturated nib of the marker 1130 may contact and/or engage at least a portion of the thread 1120 passing through passage 1018, to provide a colored thread 1122.

In an embodiment, apparatus portion 1100 does not include housing 1010 described above with regard to FIG. 10. Instead, the components of apparatus portion 1100 may be coupled to at least a portion of housing 7 that is usable with an embodiment of the thread wrapping machine described above with regard to FIGS. 1-9. In an embodiment, disc 9 and the attached fixtures are removable from housing 7, and apparatus portion 1100 is configured to be removably affixed to housing 7 in place of disc 9. The rotatable member (described above with regard to FIG. 10) and/or holding member 1012 may then be rotated directly or indirectly by a drive within housing 7. In an embodiment, a portion of housing 7 adjacent to disc 9 is removable, such that the portion of housing 7 and disc 9 are removed together, and the partial housing affixed to apparatus portion 1100 is configured to removably attach to housing 7 in place of the removed portion of housing 7.

Figure 12:
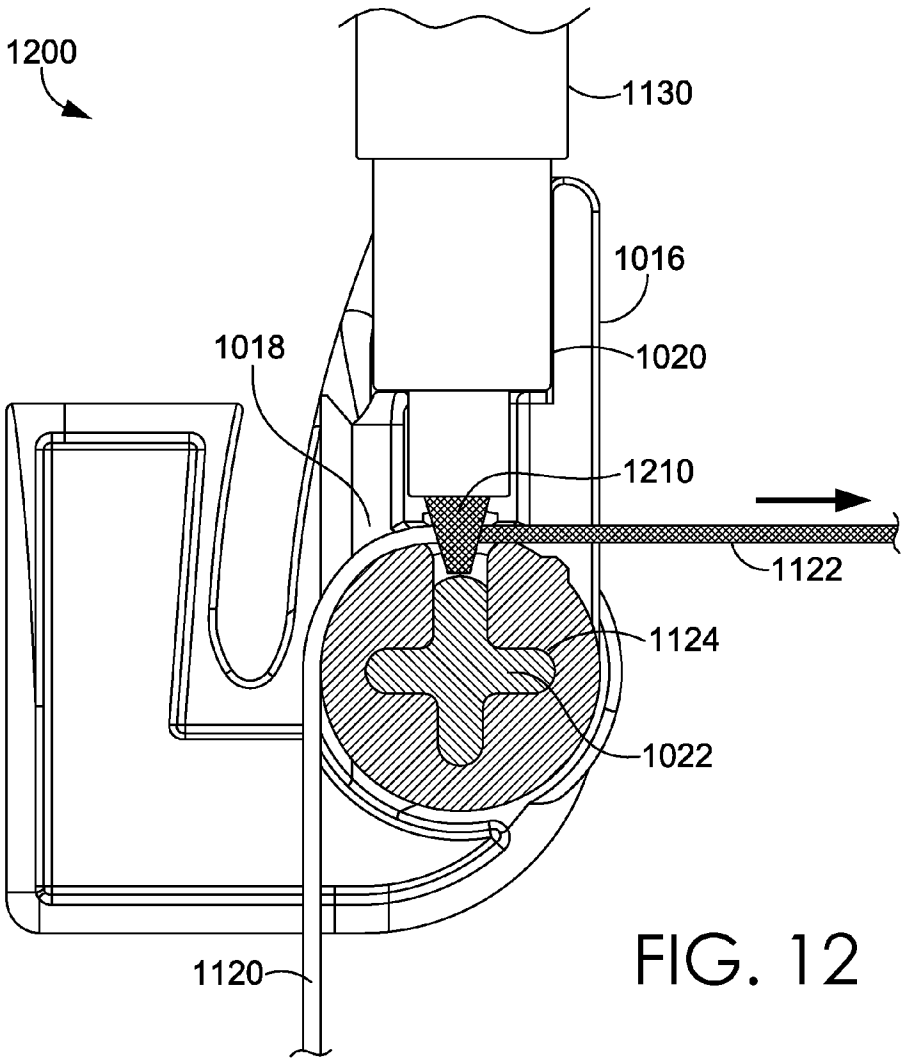
FIG. 12 illustrates an enlarged cross sectional view of exemplary thread guide in accordance with an embodiment of the invention.

Referring now to FIG. 12, a cross sectional view of an embodiment of primary thread guide 1016 is depicted, and is generally referred to as cross sectional view 1200. Primary thread guide 1016 is but one example of a suitable primary thread guide, and is not intended to suggest any limitation as to the scope of use or functionality of embodiments of the invention. Neither should primary thread guide 1016 be interpreted as having any dependency or requirement relating to any single component or combination of components illustrated therein.

As described above with regard to FIG. 10, in an embodiment primary thread guide 1016 is mounted on a primary guide support member 1022 which includes a shaft 1038 on which primary thread guide 1016 is movably mounted, such that primary thread guide 1016 is slidable back and forth along a longitudinal axis of the shaft 1038 of primary guide support member 1022. In an embodiment, the shaft 1038 of primary guide support member 1022 has a cross sectional shape that matches a cross sectional shape of an opening 1124 in primary thread guide 1016, such that primary thread guide 1016 is maintained in an upright position, or in a non-rotating position, as primary thread guide 1016 slides along an axis of primary guide support member 1022. In an embodiment, the cross section of primary guide support member 1022 approximates a "plus sign" as depicted in FIG. 12. As such, the external surface of the primary support guide 1022 may correspond to an internal surface of the opening 1124 in the primary thread guide 1016, which restricts rotation of the primary thread guide 1016 and maintains alignment between the thread 1120 and the receptacle 1020. The cross section of primary guide support member 1022 may also have other shapes corresponding to an internal surface of the opening 1124.

Cross sectional view 1200 also depicts marker 1130 that is inserted into receptacle 1020, contacting at least a portion of thread 1120 to provide colored thread 1122. As depicted, thread 1024 passes through passage 1018 and is disposed against a marking portion 1210 of marker 1130. Marker 1130 and/or marking portion 1210 may be any portion of a marking device configured to deliver a coloring solution and/or apply a color to the thread 1120, such as a broad line Crayola® marker from Easton, PA. In one aspect, a coloring solution within a marker reservoir is directed onto the thread 1120 based on contacting the marker nib 1210. In an embodiment, the thread 1120 is disposed against the side of the marker nib 1210. In another embodiment, the thread 1120 is disposed against or beneath the tip of the marker nib 1210. Examples of a coloring solution include a fabric marker solution, a permanent marker solution, ink, dye, and so forth. As thread 1024 is drawn through passage 1018 it is colored by marking portion 1210 to provide colored thread 1122.

Figure 13:
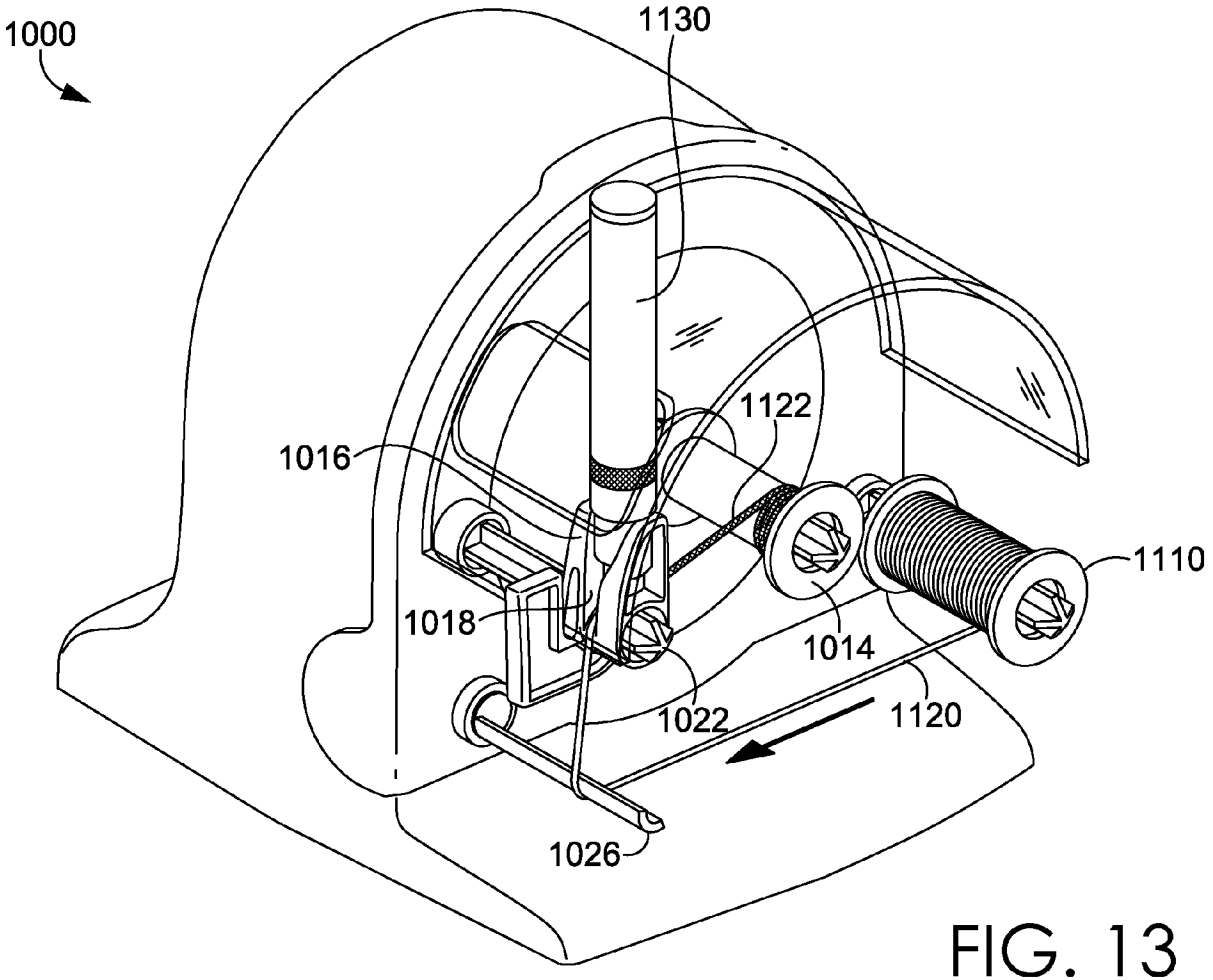
FIG. 13 illustrates an exemplary apparatus for coloring a threaded material in accordance with an embodiment of the invention.

Referring now to FIG. 13, an exemplary embodiment of apparatus 1000 is depicted with payout spool 1110, thread 1120, and marker 1130. The depicted embodiment is but one example of a suitable apparatus, and is not intended to suggest any limitation as to the scope of use or functionality of embodiments of the invention. Neither should the depicted embodiment be interpreted as having any dependency or requirement relating to any single component or combination of components illustrated therein.

As depicted, primary thread guide 1016 is located near the distal end of primary guide support member 1022. As takeup spool 1014 rotates, thread 1120 is unwound from payout spool 1110, passes around payout thread guide 1026, and is drawn through passage 1018 in primary thread guide 1016, where it is colored by marker 1130. The resultant colored thread 1122 is wound onto the distal end of takeup spool 1014, corresponding to the position of primary thread guide 1016 along the central axis of the primary guide support member 1022.

Figure 14:
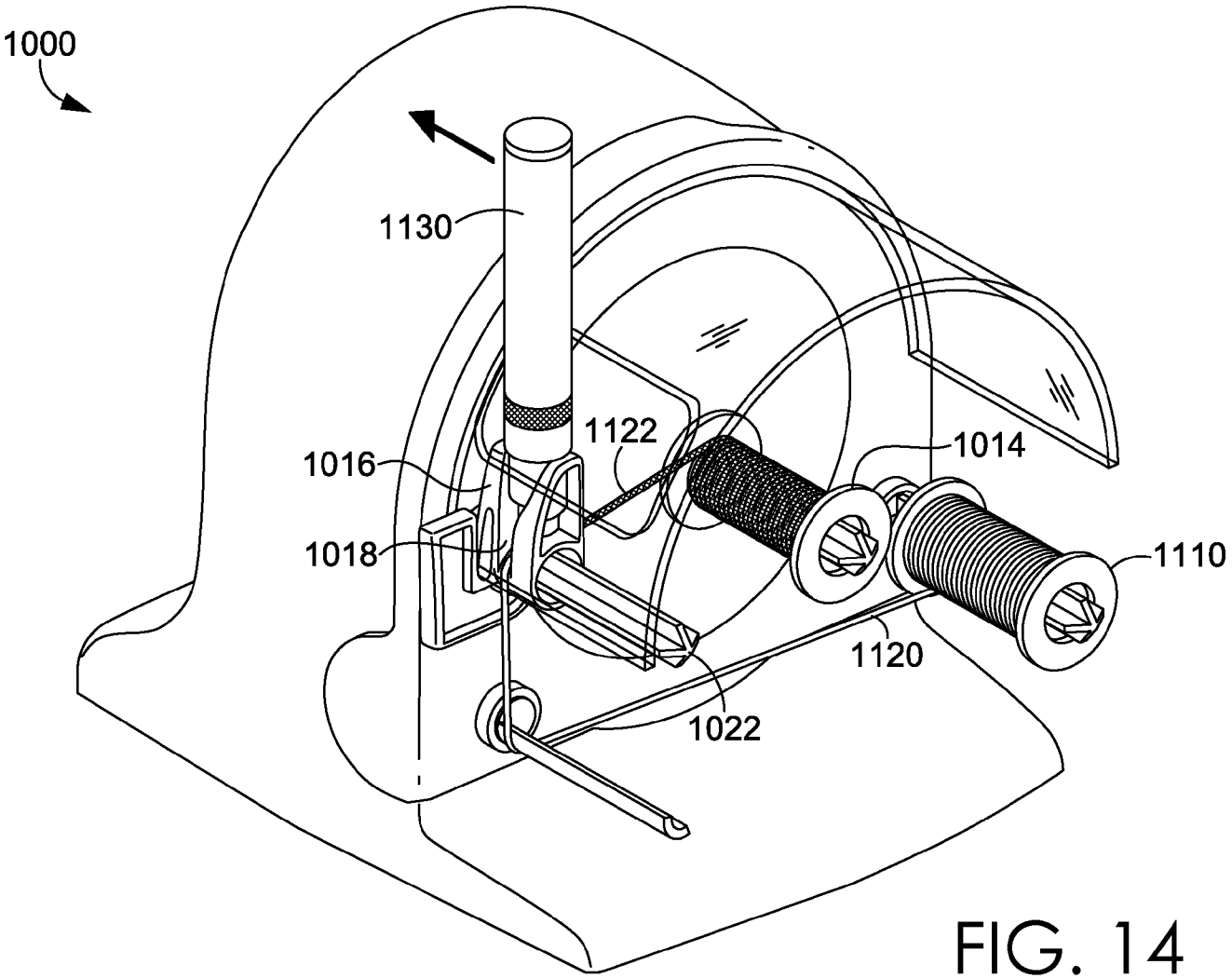
FIG. 14 illustrates an exemplary apparatus for coloring a threaded material in accordance with an embodiment of the invention.

Referring now to FIG. 14, an embodiment of apparatus 1000 is depicted with payout spool 1110, thread 1120, and marker 1130. As described above, thread 1120 is colored by marker 1130 as it is drawn through passage 1018 in primary thread guide 1016. FIG. 14 depicts primary thread guide 1016 as moved to the proximal end of primary guide support member 1022 during the winding of colored thread 1122 onto takeup spool 1014. Accordingly, the movement of primary thread guide 1016 causes colored thread 1122 to be wound evenly along takeup spool 1014. In an embodiment, primary thread guide 1016 is moved manually, while takeup spool 1014 is mechanically or automatically rotated during coloring.

Many different arrangements of the various components depicted, as well as components not shown, are possible without departing from the scope of the claims below. Embodiments of our technology have been described with the intent to be illustrative rather than restrictive. Alternative embodiments will become apparent readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. An apparatus for coloring threaded material, comprising:

a housing;

a cover affixed to the housing;

a drive member configured to rotate a takeup spool;

a primary thread guide comprising a passage configured to guide a threaded material as the threaded material is wound onto the takeup spool; and the primary thread guide further comprising a receptacle configured to receive a marking device, wherein the receptacle is configured to dispose a colorant-delivering portion of the marking device against the threaded material;

wherein the cover at least partially encases the drive member, and wherein the cover is positioned as a protective guard against rotating components of the apparatus; and wherein a portion of the cover forms an aperture positioned such that the aperture accepts the marking device when the marking device is inserted into the receptacle of the primary thread guide.

2. The apparatus of claim 1, wherein the primary thread guide is movably mounted on a primary guide support member and is configured to move between a location nearer a first end of the take up spool and a location nearer a second end of the takeup spool, wherein the first end and the second end are with respect to a longitudinal length of the takeup spool.

3. The apparatus of claim 2, further comprising a payout support member configured to rotatably support a payout spool.

4. The apparatus of claim 3, further comprising a payout thread guide configuted to guide the threaded material toward the primary thread guide as the threaded material is unwound from the payout spool.

5. The apparatus of claim 4, further comprising the housing having a face, wherein the drive member, the primary guide support member, the payout support member, and the payout thread guide protrude from the face of the housing.

6. The apparatus of claim 5, wherein the face is removable from the housing.

7. The apparatus of claim 5, further comprising the cover at least partially encasing the primary guide support member, the primary thread guide, the payout support member, and the payout thread guide.

8. The apparatus of claim 7, wherein the aperture is sized to penult movement of the marking device with respect to the primary guide support member when the primary thread guide moves longitudinally with respect to the takeup spool.

9. The apparatus of claim 7, wherein the cover is at least partially transparent.

10. An apparatus for coloring threaded material, comprising:

a housing;

a shield at to the housing;

a payout support member configured to support a payout spool;

a drive member configured to rotate a takeup spool; and a coloring assembly comprising A) a colorant applicator holding portion configured to receive a colorant applicator, and B) a passage configured to receive a thread and to dispose the thread against the colorant applicator as the thread is wound onto the takeup spool, wherein the coloring assembly is positioned to direct the thread drawn through the passage toward a portion of the takeup spool;

wherein the shield is positioned to provide a protective covering over the drive member;

wherein a portion of the shield forms an aperture positioned such that the aperture accepts the colorant applicator when the colorant applicator is inserted into the colorant applicator holding portion.

11. The apparatus of claim 10, further comprising a support member configured to movably support the coloring assembly, such that movement of the coloring assembly changes the portion of the takeup spool toward which the thread is directed.

12. The apparatus of claim 10, further comprising a payout thread guide configured to guide the thread toward the coloring assembly as the thread is unwound from the payout spool.

13. The apparatus of claim 12, further comprising the shield positioned to provide a protective covering over one or more of the coloring assembly, the payout support member, and the payout thread guide.

14. The apparatus of claim 10, wherein the coloring assembly comprises a marking device that includes the colorant applicator.

15. An apparatus for coloring a thread material, comprising:

a housing;

a cover affixed to the housing;

a rotatable member mounted in the housing, wherein the housing includes a drive that rotates the rotatable member, a holding member protruding from the rotatable member, wherein the holding member is configured to receive a takeup spool;

a payout support member configured to rotatable support a payout spool comprising the thread material;

a primary thread guide comprising a passage configured to receive the thread material, the primary thread guide positioned to direct the thread material toward a potion of the takeup spool as the thread material is unwound from the payout spool and wound onto the takeup spool, wherein the primary thread guide comprises a receptacle configured to receive a marking device, and further wherein the passage is configured to dispose the thread material against a colorant delivering portion of the marking device; and a payout thread guide configured to guide the thread material toward the primary thread guide as the thread material is unwound from the payout spool;

wherein the cover at least partially encases the holding member, and wherein the cover is positioned as a protective guard between a user and one or more moving components of the apparatus; and wherein a portion of the cover forms an aperture positioned such that the aperture accepts the marking device when the marking device is inserted into the receptacle of the primary thread guide.

16. The apparatus of claim 15, further comprising a primary guide support member configured to movably support the primary thread guide, such that movement of the primary thread guide along an axis of the primary guide support member changes the portion of the takeup spool toward which the thread is directed.

17. The apparatus of claim 16, further comprising the cover at least partially encasing the primary guide support member, the primary thread guide, the payout support member, and the payout thread guide.

18. The apparatus of claim 17, wherein a portion of the primary thread guide extends beyond the cover.

19. The apparatus of claim 18, wherein the portion of the primary thread guide that extends beyond the cover comprises a notch that engages an edge of the cover.

20. An apparatus for coloring threaded material, comprising:

a drive member configured to rotate a takeup spool;

a primary thread guide comprising a passage configured to guide a threaded material as the threaded material is wound onto the takeup spool; and the primary thread guide further comprising a receptacle configured to receive a marker that is inserted into the receptacle, wherein the marker includes a marker nib that delivers a colorant, and wherein the receptacle is configured to position the marker nib in contact with the threaded material such that the marker nib delivers the colorant onto the threaded material.

21. The apparatus of claim 20, wherein the primary thread guide is movably mounted on a primary guide support member and is configured to move between a location nearer a first end of the take up spool and a location nearer a second end of the takeup spool, wherein the first end and the second end are with respect to a longitudinal length of the takeup spool.

22. The apparatus of claim 21, further comprising a payout support member configured to rotatably support a payout spool.

23. The apparatus of claim 22, further comprising a payout thread guide configured to guide the threaded material toward the primary thread guide as the threaded material is unwound from the payout.

24. The apparatus of claim 23, further comprising a housing having a face, wherein the drive member, the primary guide support member, the payout support member, and the payout thread guide protrude from the face of the housing.

25. The apparatus of claim 24, wherein the face is removable from the housing.

26. The apparatus of claim 24, further comprising a cover at least partially encasing the drive member, the primary guide support member, the primary thread guide, the payout support member, and the payout thread guide, and wherein the cover is positioned as a protective guard against rotating components of the apparatus.

27. The apparatus of claim 26, wherein an aperture in the cover accepts the marking device when the marking device is inserted into the receptacle of the primary thread guide, and wherein the aperture is sized to permit movement of the marking device with respect to the primary guide support member when the primary thread guide moves longitudinally with respect to the takeup spool.

28. The apparatus of claim 26, wherein the cover is at least partially transparent.

29. An apparatus for coloring a thread material, comprising:

a housing;

a rotatable member mounted M the housing, wherein the housing includes a drive that rotates the rotatable member;

a holding member protruding from the rotatable member, wherein the holding member is configured to receive a takeup spool;

a payout support member configured to rotatably support a payout spool comprising the thread material;

a primary thread guide comprising a passage configured to guide the thread material as the thread material is wound onto the takeup spool;

the primary thread guide farther comprising a receptacle configured to receive a marker that is inset ted into the receptacle, wherein the marker includes a marker nib that delivers a colorant, and wherein the receptacle is configured to position the marker nib in contact with the thread material such that the marker nib delivers the colorant onto the thread material; and a payout thread guide configured to guide the thread material toward the primary thread guide as the thread material is unwound from the payout spool.

30. The apparatus of claim 29, further comprising a primary guide support member configured to movably support the primary thread guide, such that movement of the primary thread guide along an axis of the primary guide support member changes the portion of the takeup spool toward which the thread is directed.

* * * * *